US005792226A

United States Patent [19]

Lee et al.

[11] Patent Number: 5,792,226

[45] Date of Patent: Aug. 11, 1998

[54] AIR CURRENT CONTROLLING DEVICE AND CLEAN ROOM ADOPTING THE SAME

[75] Inventors: Joung-sun Lee, Suwon; Jae-jun Ruy, Seoul; Kun-hyung Lee, Seongnam; Sang-young Mun, Ansan, all of Rep. of Korea

[73] Assignee: Samsung Electronics Co., Ltd., Suwon, Rep. of Korea

[21] Appl. No.: 752,385

[22] Filed: Nov. 20, 1996

[30] Foreign Application Priority Data

Nov. 20, 1995 [KR] Rep. of Korea ..... 95-42341

[51] Int. Cl.[6] ..... B01D 46/10; B01L 1/04

[52] U.S. Cl. ..... 55/385.2; 55/415; 454/187; 454/298; 454/333

[58] Field of Search ..... 55/321, 328, 385.2, 55/415, 462; 454/187, 284, 292, 296, 298, 333, 334

[56] References Cited

U.S. PATENT DOCUMENTS

| | | | |
|---|---|---|---|
| 2,104,279 | 1/1938 | Sperry | 454/333 |
| 2,783,702 | 3/1957 | O'Day | 454/333 |
| 2,822,741 | 2/1958 | Kennedy | 454/298 |
| 3,179,125 | 4/1965 | O'Day et al. | 454/333 |
| 3,465,666 | 9/1969 | Knab | 454/187 |
| 3,473,461 | 10/1969 | Madl, Jr. | 454/187 |
| 4,548,068 | 10/1985 | Gualtieri et al. | 55/385.2 |
| 4,666,477 | 5/1987 | Lough | 55/385.2 |
| 4,917,713 | 4/1990 | Helmus | 55/385.2 |
| 5,167,577 | 12/1992 | Kristensson | 454/298 |
| 5,322,533 | 6/1994 | Todorovic | 55/385.2 |

FOREIGN PATENT DOCUMENTS

| | | | |
|---|---|---|---|
| 63-172858 | 7/1988 | Japan | 454/298 |
| 686666 | 12/1948 | United Kingdom . | |
| 2 155 170 | 3/1984 | United Kingdom . | |

*Primary Examiner*—C. Scott Bushey
*Attorney, Agent, or Firm*—Jones & Volentine L.L.P.

[57] ABSTRACT

An air current controlling device for a clean room having a high efficiency particle filter, a housing cap for the filter, and an air current directional controller provided between the filter and the housing cap. The controller has a shaft extending therefrom, which extends through a central opening in the bottom of the housing cap. The controller includes a plurality of extendable and retractable blades, each being connected to a square plate that is in turn connected to the shaft. A clean room having the above air current controlling device installed in each air inlet is capable of widely distributing the clean air in the clean room. The wide air distribution reduces the temperature difference in the clean room, while optimizing the relative humidity and thereby reducing the electrostatic level of the clean room.

6 Claims, 6 Drawing Sheets

AIR CURRENT CONTROLLING DEVICE AND CLEAN ROOM ADOPTING THE SAME

BACKGROUND OF THE INVENTION

1. Field of the Invention

The present invention relates to an air current controlling device and a clean room adopting the same, and more particularly, to a device for distributing an introduced air current, at a large angle, in a clean room and a clean room adopting the same.

2. Background of the Related Art

A clean room is used for fabricating highly integrated semiconductor devices, the elements of which are as tiny as microns, through complex process steps susceptible to contamination by dust or even smaller particles. It is therefore important to keep the working environment for such processing absolutely clean to alleviate contamination and process complexity.

The semiconductor industry owes its development largely to the evolution of the clean room. Since the emergence of transistors in the middle of the twentieth century and the accompanying creation of integrated circuits, there has been a revolution in bio clean rooms for the pharmaceutical and genetic engineering industries, and industrial clean rooms (ICR) for the precision industry, robotics, and electronics.

Clean rooms are largely categorized into laminar type or convective type. The laminar clean room, being provided with more filters on the ceiling than the convective type, obtains a higher degree of cleanliness. This advantage makes the laminar type suitable for semiconductor device manufacturing processes requiring a high degree of cleanliness. In addition, the laminar clean room is designed to deal with the heat generated from the processing equipment as well as that emanating from human bodies.

A convective clean room, on the other hand, is more suited to a process requiring a lower level of cleanliness, such as assembly or testing. The convective clean room, however, has distinct structural problems that adversely affect products manufactured in the clean room. Moreover, the structural problems lower the working efficiency of an operator in the clean room.

An example of a conventional convective clean room for a semiconductor fabrication process is illustrated in FIG. 1. In FIG. 1, reference numeral 8 denotes a clean room, and reference numeral 14 denotes production equipment. Reference numeral 10 denotes an inlet for introducing an air current 16 into the clean room 8. Here, the inlet 10 includes a generally used filter 22 having crimped outer walls as shown in FIG. 4. This filter 22 is installed in the structure 18 of FIG. 3. The bottom of structure 18 of FIG. 3 is opened and the lateral walls thereof are formed of an opaque material. The air current inlet 10 in the clean room 8 has a filter housing cap 23 (a diffuser) shown in FIG. 5. The filter housing cap 23 has a plurality of uniform holes 24 in the bottom thereof, as shown in FIG. 5. Air current 16 (see FIG. 1) filtered by the filter of FIG. 4 is introduced into the clean room 8 through the holes 24. Since the holes 24 are confined to the bottom of the filter housing cap 23, the air current 16 introduced into the clean room 8 is distributed in restricted directions.

Reference numeral 12 in FIG. 1 denotes an outlet for exhausting air current 16 from the clean room 8. Five areas denoted by reference characters A-E are sample areas for measuring temperatures in the clean room 8.

The level of cleanliness, temperature, and humidity of the clean room 8 should be properly controlled through a cycle of introducing the air current 16 into the clean room 8 and exhausting the air current 16 through the outlet 12 installed in the lower part of the clean room 8. The temperature of the clean room 8, however, is influenced by heat generated from the production equipments 14, such as a tester, or the person operating the tester, thus causing temperature variations in areas A–E of the clean room 8. The temperature variations are difficult to overcome using various systems compatible for controlling a clean room temperature. An example of temperature distribution in the conventional clean room is illustrated in FIG. 2.

FIG. 2 illustrates temperature variations in the sample areas A–E in the clean room 8 of FIG. 1. Referring to FIG.2, the points on the horizontal axis indicate the sample areas A–E. It is noted that the temperature distribution in the conventional clean room 8 deviates from a reference temperature range. That is, as shown, the reference temperature for the clean room 8 is in a range of 23°±1° C., while the actual temperatures measured in the sample areas A–E are about 22.5° C. and below, or about 23.5° C. and above. For instance, the temperature in the sample area A ranges between about 20.8° and 22.4° C. at its lowest, and between about 25.5° C. and 26° C. at its highest. The sample areas A–E shown in FIG. 1 reach deep into the clean room 8.

In a clean room adopting the conventional air current controlling device as described above, air current introduced into the clean room is mainly distributed downward, thereby setting a limit on narrowing the temperature differences in areas of the clean room. Further, due to these temperature differences, the relative humidity of the clean room cannot be adequately controlled, and the electrostatic level thereof increases.

SUMMARY OF THE INVENTION

Accordingly, it is an object of the present invention to provide a new air current controlling device for distributing an air current at a larger angle than in a conventional air current controlling device.

It is another object of the present invention to provide a clean room adopting the above air current controlling device.

To achieve these and other objects, the present invention provides an air current controlling device for a clean room having a high efficiency particle filter and a housing cap for the filter, comprising: means for controlling an air current direction provided between the filter and the housing cap, the means for controlling having a shaft extending therefrom, and the housing cap having a central opening formed in a bottom thereof such that the shaft extends through the bottom of the housing cap.

Preferably, the means for controlling comprises a square plate connected to the shaft, and a plurality of blades, each having an upper side connected to a respective side of the square plate, such that the blades are retracted or extended about an axis corresponding to the respective connections when the shaft is rotated.

In another aspect, there is provided a clean room, comprising: a plurality of inlets for introducing clean air; a plurality of outlets for exhausting said clean air; and an adjustable air current controlling means, located in each of the plurality of inlets, for controlling the direction of the clean air introduced thereto.

According to the present invention, an air current controlling device that widely distributes air current is used in a clean room. Since the air current is distributed at a larger angle than in a clean room employing the conventional air current controlling device, the temperature differential throughout the areas of the clean room is reduced considerably. Accordingly, the temperature and humidity of the clean room can be kept at an adequate level.

BRIEF DESCRIPTION OF THE DRAWINGS

The above objects and advantages of the present invention will become more apparent by describing in detail a preferred embodiment thereof with reference to the attached drawings in which:

FIG. 14 shows blades W1–W4 in a folded state while FIG. 15 shows the blades in an unfolded state.

DETAILED DESCRIPTION OF THE INVENTION

Figure 6:
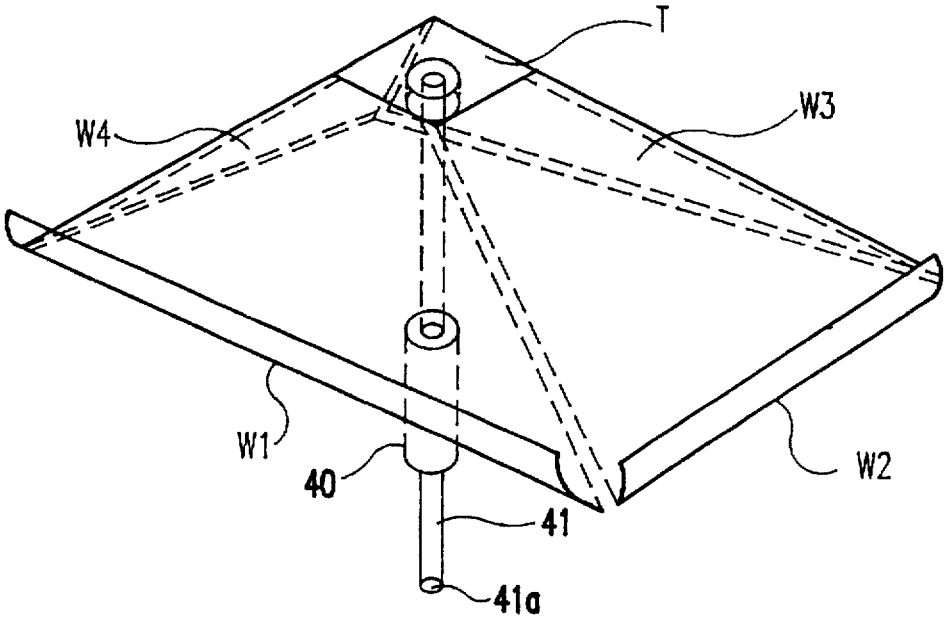
FIGS. 6, 7 and 8 are a perspective view, a plan view and a side view of an air current controlling device of the present invention, respectively.
Figure 7:
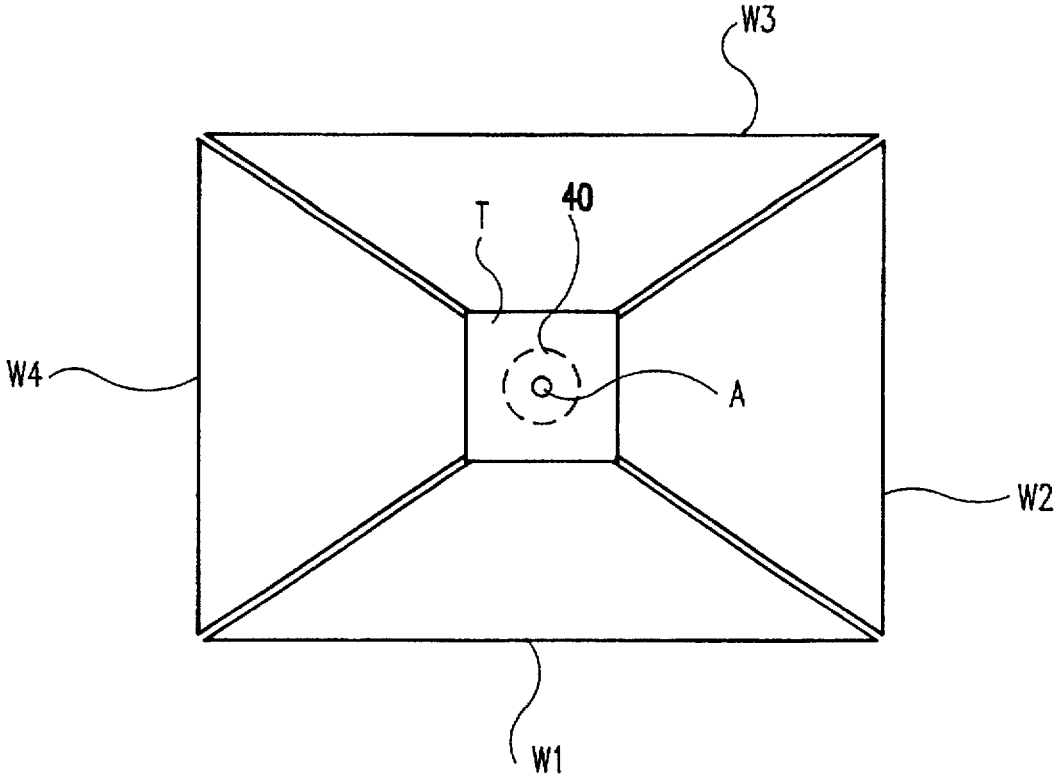
Figure 8:
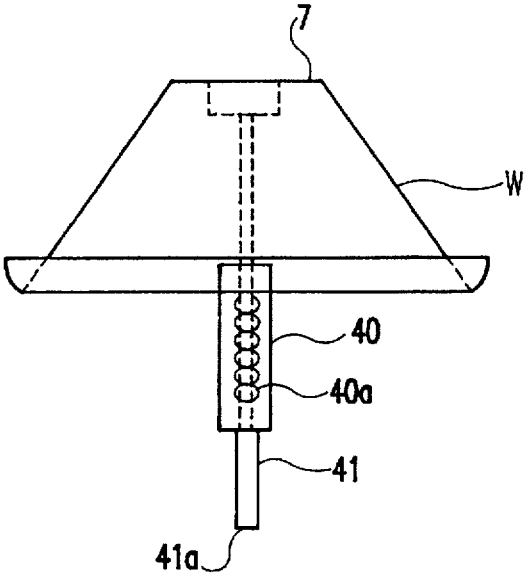

The air current controlling device of the present invention will be described in detail with reference to FIGS. 6, 7 and 8, in which FIG. 6 is a perspective view, FIG. 7 is a plan view, FIG. 8 is a side view, respectively.

The air current controlling device has four foldable blades W1–W4 of the same shape, a square plate T, and a shaft 41. Each of the blades W1–W4 has a quadrilateral shape, meaning it has four sides and four angles. Specifically, the upper sides are parallel with the lower sides, with the lower side being longer than the upper side. The right and left sides of the blades W1–W4 are of equal length, hence, the right and left sides of each blade are inclined to the same degree. The blade, therefore, is more specifically described as having a trapezoid shape (a quadrilateral having only two sides parallel). Each side of the square plate T is connected to the upper side of each of the blades W1–W4 such that the blades W1–W4 are movable about the connecting edge, that is, they may be extended or retracted about the connecting edge.

The shaft 41 is vertically connected to the center of the square plate T and has a structure 40 with a spring 40*a* which functions as a means for alleviating tension that is applied to the shaft 41 when the blades W1–W4 are unfolded. On the whole, the air current controlling device of the present invention is shaped like an umbrella, with the shaft 41 serving as its handle.

FIG. 8 is a side view of the air current controlling device shown in FIG. 6. Referring to FIG. 8, reference designation W denotes one of the blades of the air current controlling device. The shaft 41 is vertically connected to the square plate T. The blade W is unfolded by rotating an end portion 41*a* of the shaft 41 with a tool such as a screw driver.

The operation of the air current controlling device of the present invention as constituted above will now be described.

When the end portion 41*a* of the shaft 41 is rotated with the tool, the blades W1-W4 are simultaneously unfolded outward at a predetermined angle. Accordingly, an air current introduced from above the air current controlling device can be widely distributed, as desired.

Figure 4:
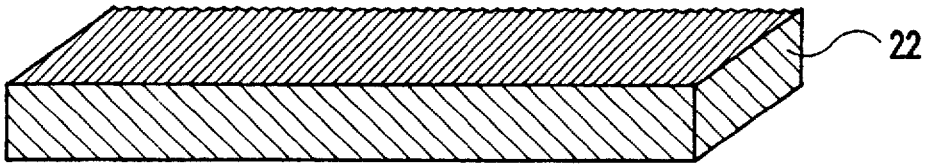
FIG. 4 shows a filter used in the clean room of FIG. 1.
Figure 5:
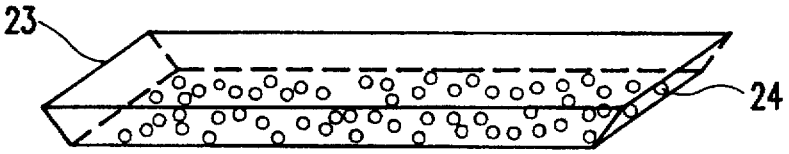
FIG.5 PRIOR ART
FIG. 5 shows a conventional filter housing cap used in the clean room of FIG. 1.
Figure 9:
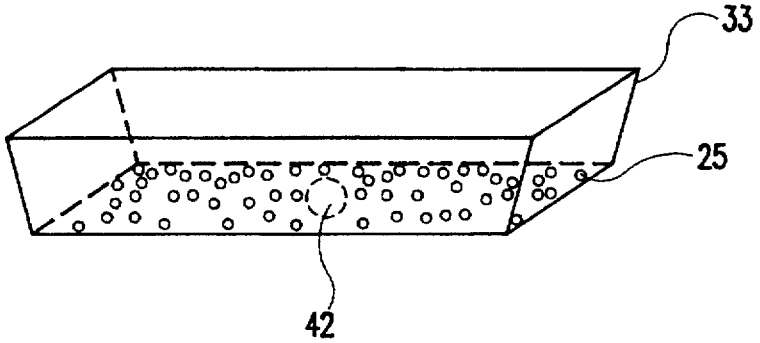
FIG. 9 is a perspective view of a filter housing cap of the present invention.
Figure 14:
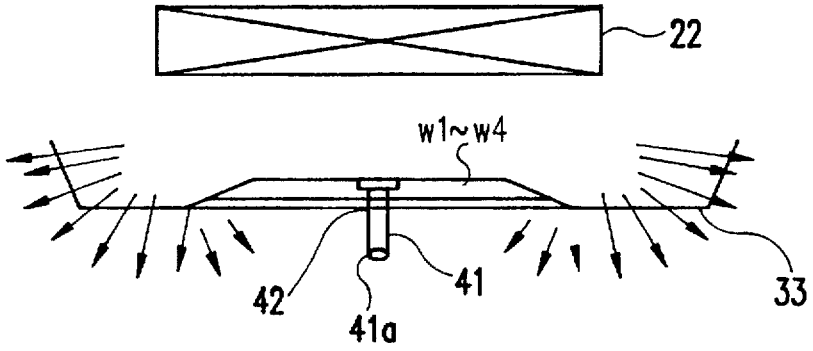
FIGS. 14 and 15 illustrate a perspective view of the present air current controlling device provided between the filter and the housing cap.
Figure 15:
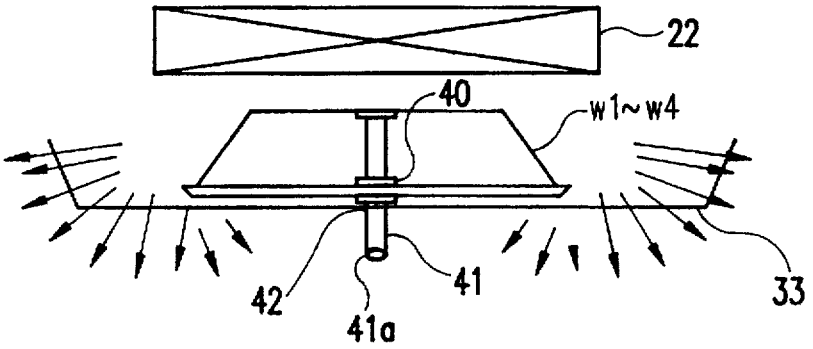

Fig. 14 and 15 illustrate the air current controlling device installed between the high efficiency particle filter 22 (see FIG. 4, hereinafter referred to as filter) in the clean room and the filter housing cap 33 (see FIG. 9) of the present invention. The filter housing cap 33 of the present invention has a hole 42 of a predetermined diameter in the center of the bottom thereof, as shown in FIG. 9, so that the shaft 41 of FIG. 6 can penetrate through the hole 42. A plurality of holes 25 of a smaller diameter than that of the hole 42 are formed around the hole 42 in the bottom of the filter housing cap 33.

Figure 10:
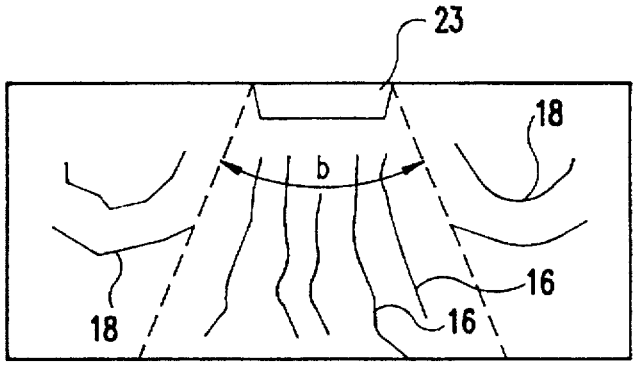
FIG.10 PRIOR ART
FIGS. 10 and 11 illustrate the air current distribution in the conventional clean room and in a clean room of the present invention, respectively.
Figure 11:
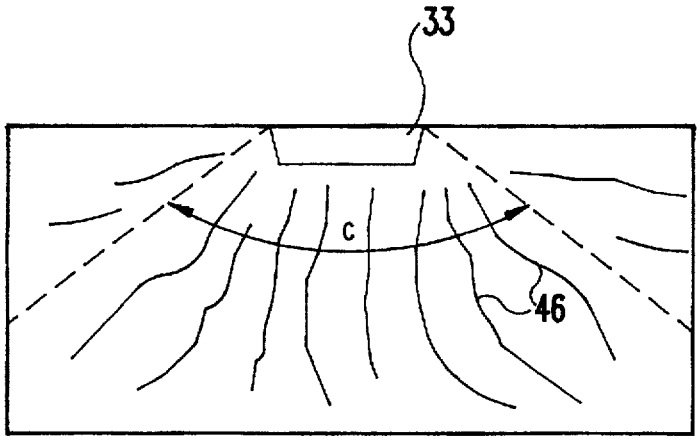

FIGS. 10 and 11 show air current distributions in the conventional clean room and the clean room of the present invention, respectively.

In FIG. 10, the distribution angle b of the air current 16 flowing into the conventional clean room is 30–45° . Air current 18 depicts the irregular air flow near the filter housing cap 23 resulting from the narrow distribution angle b.

On the other hand, referring to FIG. 11, the distribution angle c of an air current 46 flowing into the clean room of the present invention is 45–150° , due to the adjustable air current controlling device of the present invention interfacing with the filter housing cap 33 covering the air inlet.

The temperature distribution in the clean room according to the distribution angle of the air current introduced into the clean room will be described with reference to FIGS. 12 and 13.

Figure 1:
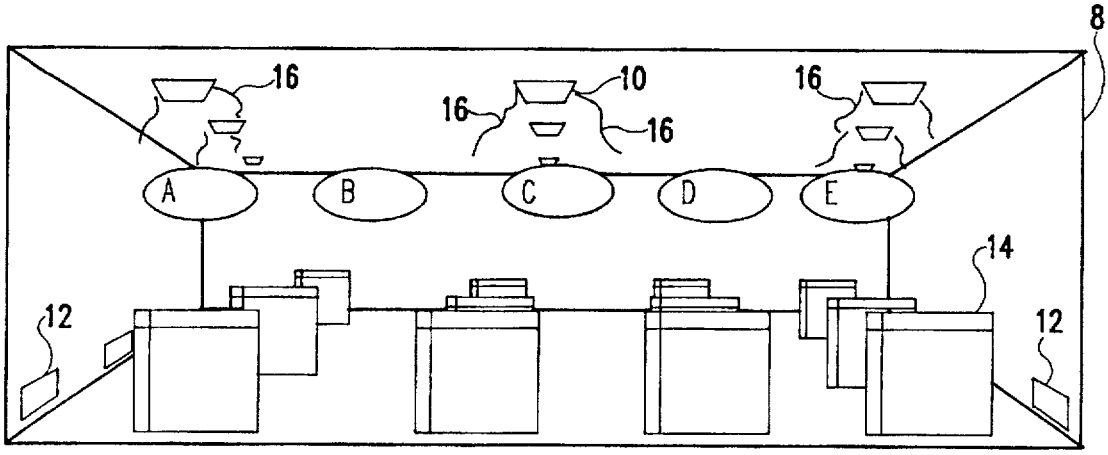
FIG.1 PRIOR ART
FIG. 1 shows a clean room employing a conventional air current controlling device.
Figure 2:
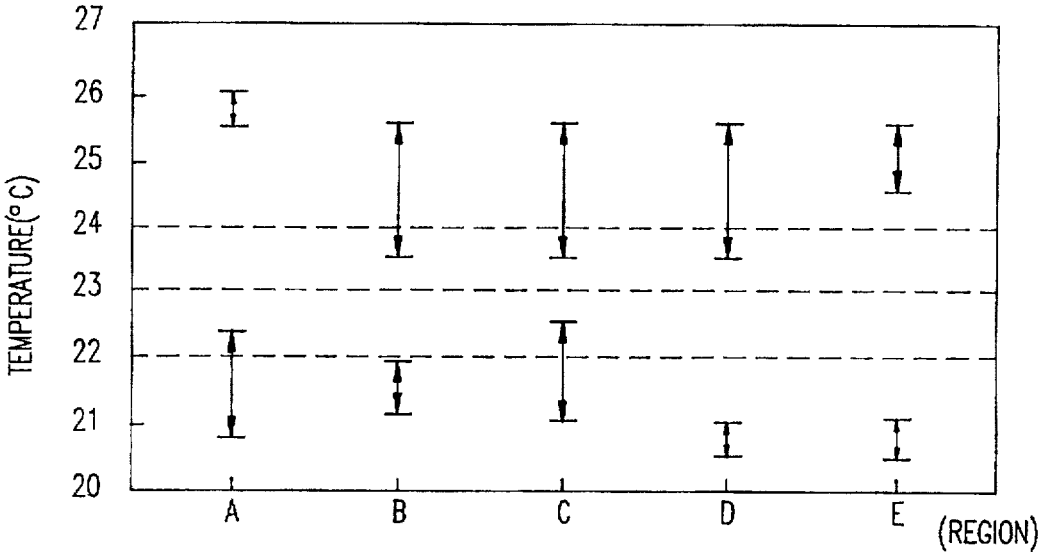
FIG.2 PRIOR ART
FIG. 2 shows a temperature distribution in the clean room of FIG. 1.
Figure 3:
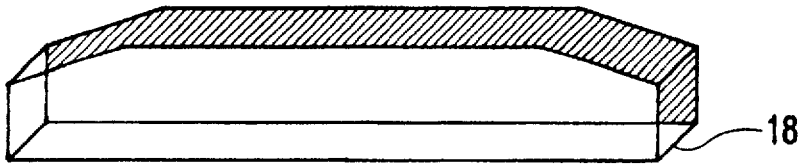
FIG. 3 shows an air supply device used in the clean room of FIG. 1.
Figure 12:
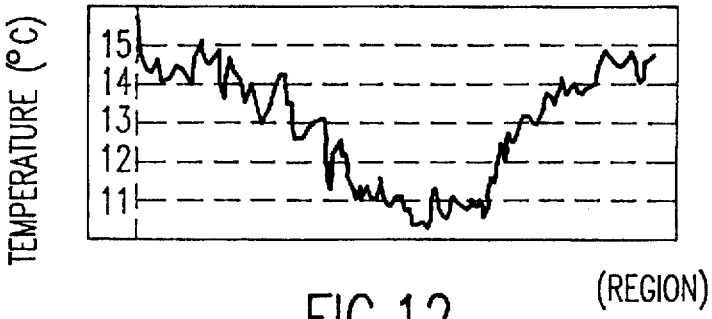
FIG. 12 PRIOR ART
FIGS. 12 and 13 are graphs of air current temperature distributions measured in the conventional clean room and in the clean room of the present invention, respectively.

FIG. 12 is a graph of the temperature distribution measured in the conventional clean room. This graph indicates that the temperature in the conventional clean room is between 10° C. and 15° C. Thus, with a reference temperature of 13° C. for the entire clean room, the temperature difference is ± 2–3° C. This temperature difference agrees with the temperature difference in the specific areas of the clean room shown in FIG. 2.

Figure 13:
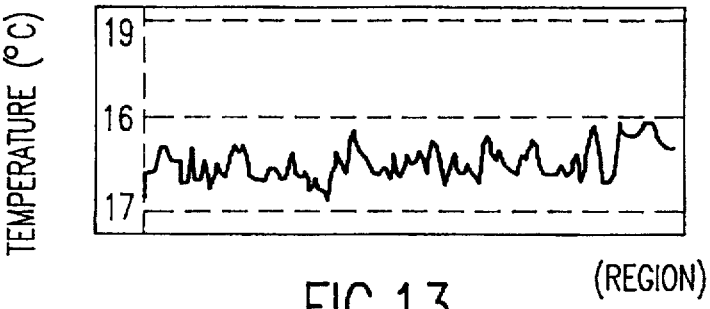

On the other hand, the graph of FIG. 13 shows that the temperature in the clean room adopting the air current controlling device of the present invention varies by less than 1°± C., while maintaining a temperature of between 17–18°± C.

As described above, an air current introduced into an area requiring a predetermined level of cleanliness can be widely distributed by employing the air current controlling device of the present invention. When the air current controlling device of the present invention is employed in a clean room, the air current is widely distributed, thereby considerably reducing the temperature difference in the clean room, while keeping the temperature and humidity of the clean room at an adequate level, which leads to a decrease in the electrostatic level thereof. Accordingly, incidences of product failures can be decreased considerably.

While the present invention has been particularly shown and described with reference to the particular embodiments thereof, it will be understood by those skilled in the art that various changes in form and details may be effected therein without departing from the spirit and scope of the invention as defined by the appended claims.

what is claimed is:

1. An air current controlling device for use in a clean room having a high efficiency particle filter and a housing cap for said filter, said air current controlling device comprising:

means for controlling air current direction provided between said filter and said housing cap, comprising a shaft, a square plate connected to one end of said shaft, and a plurality of blades, each blade having an upper side connected to a respective side of said square plate, such that said blades are retracted or extended about an axis corresponding to the respective connections when said shaft is rotated, said shaft comprising a spring for alleviating tension applied to said shaft when said blades are retracted or extended, and said housing cap having a central opening formed in a bottom thereof such that another end of said shaft extends through said bottom of said housing cap.

2. An air current controlling device as claimed in claim 1, wherein each of said blades has a quadrilateral shape.

3. An air current controlling device as claimed in claim 1, wherein each of said blades has a trapezoid shape.

4. A clean room, comprising:

a plurality of inlets for introducing clean air;

a plurality of outlets for exhausting said clean air; and an adjustable air current controlling means located in each of said plurality of inlets, for controlling direction of introduced clean air, said air current controlling means comprising a shaft, a square plate connected to one end of said shaft, and a plurality of blades, each blade having an upper side connected to a respective side of said square plate, such that said blades are retracted or extended about an axis corresponding to the respective connections when said shaft is rotated, said shaft comprising a spring for alleviating tension applied to said shaft when said blades are retracted or extended.

5. A clean room as claimed in claim 4, wherein said air current controlling means is installed between a high efficiency particle filter and a housing cap, said housing cap having a central opening formed in a bottom thereof such that the shaft extends through the bottom of said housing cap.

6. A clean room as claimed in claim 5, wherein said clean room is of convective type.

* * * * *